US006154985A

United States Patent [19]

Champagne et al.

[11] Patent Number: 6,154,985

[45] Date of Patent: Dec. 5, 2000

[54] RETRACTABLE PIVOTING SCRAPER BLADE FOR SNOW BLOWER

[75] Inventors: Christian Champagne; Réjean Pronovost, both of St-Tite, Canada

[73] Assignee: Les Machineries Pronovost Inc., Canada

[21] Appl. No.: 09/113,798

[22] Filed: Jul. 7, 1998

[30] Foreign Application Priority Data

Jan. 6, 1998 [CA] Canada ..... 2224443

[51] Int. Cl.[7] ..... E01H 5/09

[52] U.S. Cl. ..... 37/222; 37/223; 37/242; 37/253; 37/254; 37/257; 37/266

[58] Field of Search ..... 37/253, 254, 242, 37/214, 266, 241, 223, 219, 196, 206, 205, 222, 257

[56] References Cited

U.S. PATENT DOCUMENTS

| | | | |
|---|---|---|---|
| 3,938,400 | 2/1976 | Konyha | 74/242.1 |
| 4,023,287 | 5/1977 | De Brito | 37/43 R |
| 4,951,403 | 8/1990 | Olmr | 37/262 |
| 5,020,250 | 6/1991 | Fujii et al. | 37/257 |
| 5,174,053 | 12/1992 | Takeshita | 37/258 |
| 5,410,824 | 5/1995 | Pedersen | 37/242 |
| 5,410,825 | 5/1995 | Perrelli | 37/254 |

*Primary Examiner*—Christopher J. Novosad
*Attorney, Agent, or Firm*—Pearson & Pearson, LLP

[57] ABSTRACT

A device is disclosed, for use with a snow blower being of the type having an auger, and allow it to operate while moving backwards. The device principally consists of a concave blade mounted on a snow blower, which pivots between an operative position where the blade extends close to ground and the concave surface of the blade extends in front of the auger in such a way that the blade scrapes the snow and directs it towards the auger when the snow blower is lifted up to let the snow pass under it and moves backwards, and an inoperative position where the blade is raised to a height sufficient to let the snow reach the auger when the snow blower moves forwards. A snow blower equipped with a device as defined above, for operating while moving backwards, is also disclosed as well as a method for blowing snow with a snow blower equipped with that device. Although the device has been designed to fit on a removable snow blower mounted on a motorized vehicle, it could be adapted to any type of snow blower having an auger.

12 Claims, 6 Drawing Sheets

(existing art)

(existing art)

(existing art)

RETRACTABLE PIVOTING SCRAPER BLADE FOR SNOW BLOWER

FIELD OF THE INVENTION

The present invention relates to a device for use with a snow blower having an auger, to allow the snow blower to operate while moving backwards. The device comprises a blade that scrapes the snow and directs it towards the auger when the snow blower moves backwards with the frame and auger lifted up to let the snow pass underneath. Although the device has been designed to fit on a removable snow blower of a tractor, it could be adapted to any type of snow blower having an auger.

BACKGROUND OF THE INVENTION

Two main types of snow blowers exist on the market, those being single-stage and two-stage snow blowers. The single-stage snow blower is characterized by an auger mounted transversely that conveys the snow to its center where a rotor that is integrated onto said auger, projects the snow through a vertical duct. The mechanism of a single-stage snow blower is illustrated in FIGS. 1 and 1*a,* identified as "EXISTING ART". Arrows "A" indicate the movement of the snow that is conveyed by the auger and its centrally integrated rotor; arrow "T" indicates the direction of motion of the snow blower; and arrow "N" indicates the direction of the snow that enters into the snow blower. The shortcoming of this type of snow blower is the high speed of rotation of the auger/rotor combination that is required to eject the snow.

The two-stage snow blower incorporates a second stage that is added to a first stage, which is identical to the one described for a single-stage snow blower. The second stage adds a second direction of movement to the snow following the movement initiated by the first stage. This second stage consists of an impeller mechanism that propels the snow with force out of the snow blower. FIG. 2, also identified as "EXISTING ART", illustrates the mechanism of a two-stage snow blower. Arrow "A" indicates the initial displacement of the snow by the first stage, and arrow "B", the displacement of the snow by the second stage. The second stage facilitates the ejection of the snow and allows the use of an auger turning at a moderate speed. Advantageously, the optimum speed ratio of auger and impeller are easier to control.

However, both types of snow blowers described thus far have a common shortcoming, and that is that they can only work while travelling in one direction i.e. forwardly. In many circumstances, such as residential driveways and commercial parking lots, operators must travel backwards repetitively in order to re-position the equipment to blow snow in a forward movement. Each time the operator must back up, the snow blower is unproductive. A snow blower rendered functional moving backwards would increase its profitability by greatly reducing its idle time. Furthermore, as the snow blower travels forward, it tends to push a certain amount of snow in front of it, (represented by the letter "M" in FIG. 2) which is left in front of any obstacle where the snow blower must stop and back up. Hence, another type of equipment such as a plow blade or a shovel must be used to remove the snow that has been left behind.

SUMMARY OF THE INVENTION

In order to maximize the productivity of a snow blower, a three-stage snow blower has been developed within the scope of the present invention that will allow a snow blower to blow the snow while moving backwards as well as remove accumulations of snow close to obstacles. With a device according to the present invention, a two-stage snow blower is transformed into a three-stage snow blower. More precisely, the three-stage snow blower is a two-stage snow blower on which a retractable pivoting scraper blade has been mounted. Therefore, the first and second stages of a two-stage snow blower become respectively the second and third stages of a three-stage snow blower, whereas the retractable pivoting scraper blade becomes the first stage which initiates the movement of the snow through the machine. Originally, the retractable pivoting scraper blade has been developed for use in combination with removable snow blowers installed on trucks, tractors or the like. It is to be understood that with the appropriate modifications, the retractable pivoting scraper blade can be adjusted onto other types of snow blowers having an auger, such as walk-behind snow blowers, and large self-propelled snow blowers that are integrated in a vehicle.

As the snow blower moves backwards, the retractable pivoting scraper blade extends to the ground, the snow blower is lifted up to let snow pass beneath the snow blower. Thus, the snow is scraped by the blade, and directs it toward the auger. In other words, the blade feeds snow to the auger as the snow blower travels backwards.

An object of the present invention consists in a device for use with a snow blower to allow the snow blower to operate while moving backwards. In accordance with the invention, this object is achieved with a device for use with a snow blower, said snow blower being of the type comprising:

means for moving said snow blower forwards or backwards in a given direction;

a frame having a front opening, two side portions and an auger located within the frame behind said front opening, said auger having an axis of rotation transverse to the given direction in which said snow blower moves, and two opposite ends, each of said opposite ends of the auger being rotatably fastened to a respective one of said side portions of the snow blower frame, means for driving in rotation said auger;

means for lifting up at least said frame and auger, and means for ejecting snow out of said frame and away from said snow blower when said snow blower is in operation;

said device comprising:

a blade having a concave surface, an upper part and two opposite ends, said blade being pivotally mounted on said snow blower so as to pivot about an axis parallel to the axis of rotation of the auger; and means for pivoting said blade between an operative position where the blade extends close to ground and the concave surface of said blade extends in front of said front opening in such a way that said blade scrapes the snow and directs it towards said auger when said snow blower moves backwards with the frame and auger lifted up to a predetermined height to let the snow pass, and an inoperative position where the blade is raised to a height sufficient to let the snow reach the auger when the snow blower moves forwards.

An inherent advantage of the invention is that it can be installed on existing snow blowers with the aim of maximizing productivity by rendering them functional as they travel backwards. Furthermore, the device is avantageously equipped with proximity indicator rods to allow for the clearing away of snow close to any object such as a garage door, wall or obstacle without risk of damaging it.

According to a preferred embodiment of the present invention, the device further comprises a flexible shield having an upper border and a lower border, where the upper border is attached to support means located on top of the snow blower frame, and the lower border is attached to the upper part of the blade along its length. The flexible shield, together with the blade in the operative position, cover the front opening of the snow blower frame in such a way as to prevent the snow from being ejected over the blade by the auger in rotation when the snow blower moves backwards.

When the snow blower is in operation and moves forward, the blade and flexible shield are lifted out of the way of the auger and do not in any way hinder the work of the snow blower.

A further object of the present invention is a method for blowing snow with a snow blower equipped with a device as defined above when said snow blower moves backwards, the method comprising the steps of:

lifting said snow blower to a predetermined height to let the snow pass under it;

pivoting the blade in the operative position;

driving the auger in rotation; and moving said snow blower backwards.

The invention and its advantages will be better understood after reading the non restrictive description of a preferred embodiment of the present invention. This description is given with reference to the appended drawings.

DESCRIPTION OF A PREFERRED EMBODIMENT

Figure 1:
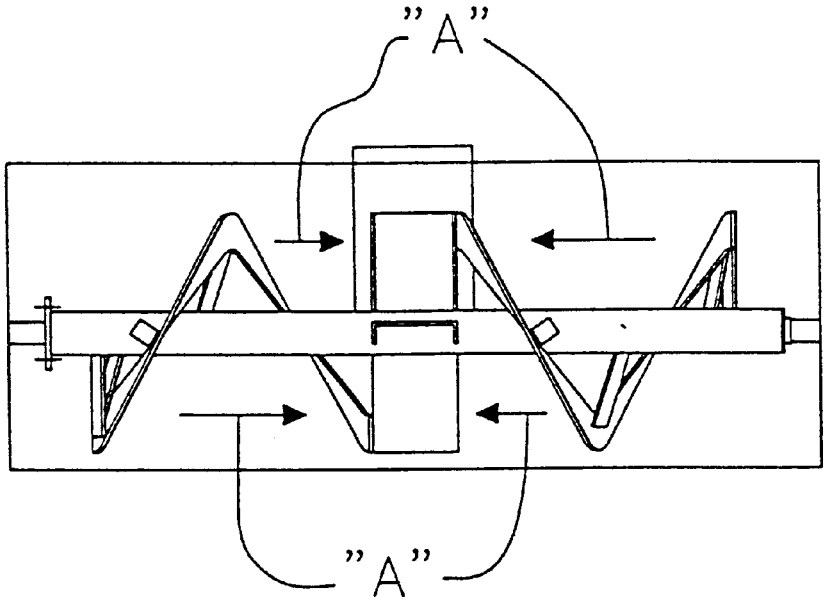
FIGS. 1 and 1*a* is a schematic representation of a single-stage snow blower as is known in existing art.
Figure 1A:
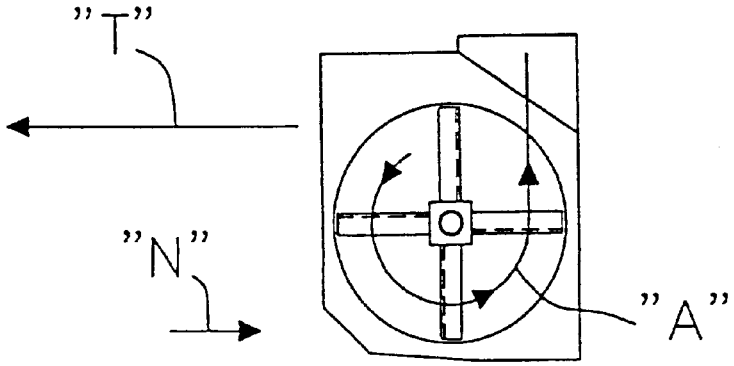
Figure 2:
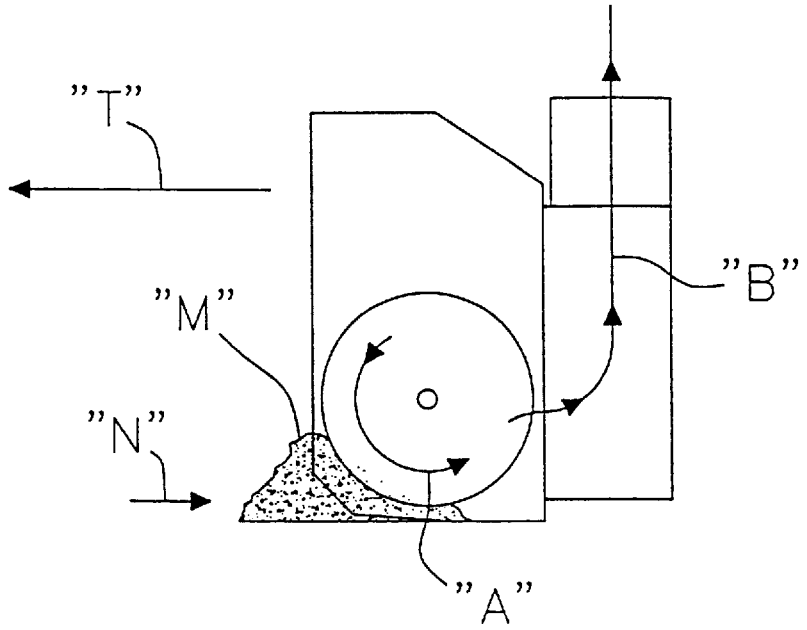
FIG. 2 is a schematic representation of a two-stage snow blower as is known in existing art.

Referring to FIGS. 4, 5, 6 and 9, a device (10) according to the present invention is used with a snow blower (2) to allow said snow blower (2) to operate while moving backwards. The device (10) has been designed especially for types of snow blowers (2) that work with an auger (4), as a removable snow blower (shown in FIGS. 4, 5 and 6) that can be mounted behind a tractor (shown in FIG. 9) or on the front of a truck as well as a walk-behind snow blower and a large self-propelled snow blower integrated in a vehicle.

Throughout the following description, the forwards movement of the snow blower (2) means that the snow blower (2) is moving in such a way that the snow (1) to be blown is facing the auger (4) as the operation of a snow blower (2) is known and executed in existing art. Thus, the backwards movement of the snow blower (2) is the movement during which the snow blower (2) can not blow the snow (1) without the device (10) of the present invention. It is to be understood that the forwards and backwards movements of the snow blower (2) are defined independently of the direction of the vehicle, tractor or truck combined with the snow blower (2), because the snow blower (2) could be mounted on the back or on the front thereof, with an opposite orientation. It should be understood that movement of the snow blower (2) and operation of the snow blower (2) have different meanings since operation involves not only movement but also rotation of the auger (4) and ejection of the snow (1).

Preferably, the snow blower (2) is of the type that comprises means for moving the snow blower (2) forwards or backwards in a given direction. The means for moving the snow blower (2) could be a motor included in a hand-propelled snow blower, a tractor or a truck on which a removable snow blower is mounted, or a vehicle in which a snow blower is incorporated. The snow blower (2) further comprises a frame (6) having a front opening (3), two side portions (7) and an auger (4) located within the frame (6) behind said front opening (3).

Figure 7:
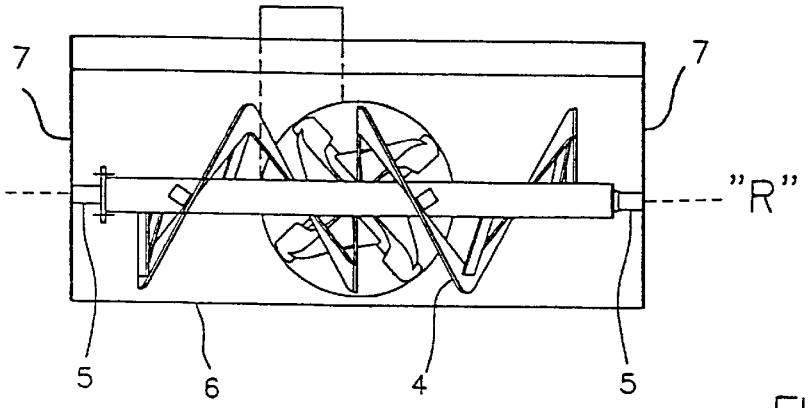
FIG. 7 is a front view of the frame of the snow blower illustrated in FIGS. 4 to 6, showing the auger and impeller mechanisms.
Figure 8:
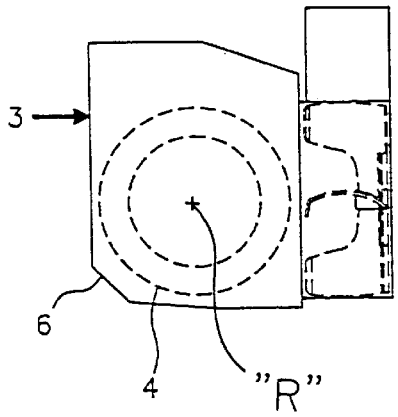
FIG. 8 is a side view of the frame of the snow blower illustrated in FIGS. 4 to 6.
Figure 9:
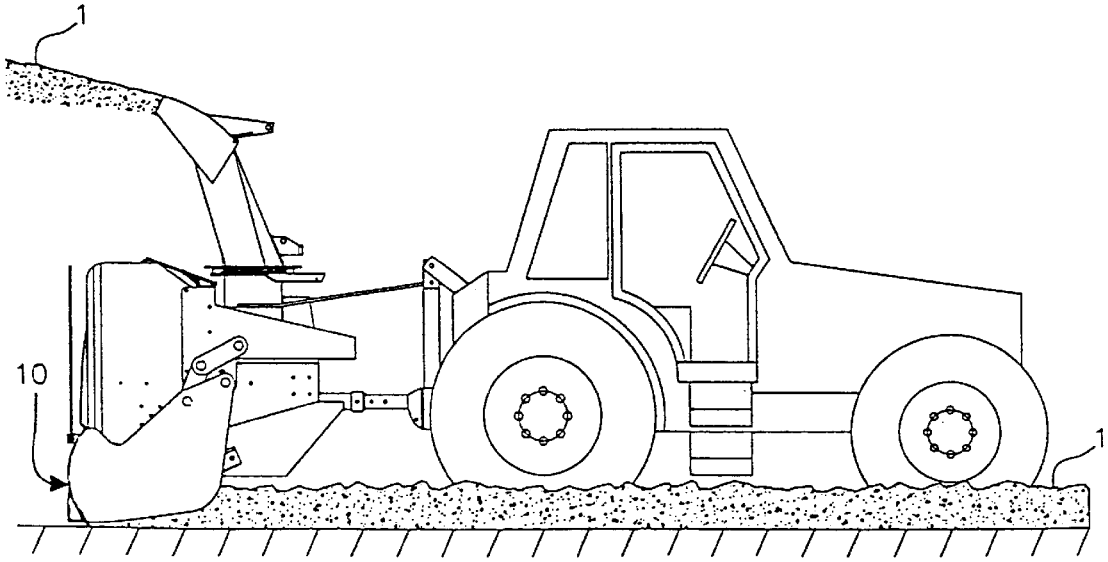
FIG. 9 shows a removable snow blower including a device according to a preferred embodiment of the present invention mounted on a tractor.

As illustrated in FIGS. 7 and 8, the auger (4) has an axis of rotation "R" transverse to the given direction (represented by the arrow "T" in the FIG. 3) in which the snow blower (2) moves, and two opposite ends (5). Each of the opposite ends (5) of the auger (4) is rotatably fastened to a respective one of the side portions (7) of the snow blower frame (6). The snow blower (2) also comprises means for driving in rotation the auger (4); means for lifting up at least the frame (6) and auger (4); and means for ejecting snow (1) out of the frame (6) and away from the snow blower (2) when the snow blower (2) is in operation. The means for driving in rotation the auger (4) and the means for ejecting snow (1) out of the frame (6) and away from the snow blower (2) are well known in existing art.

Figure 3:
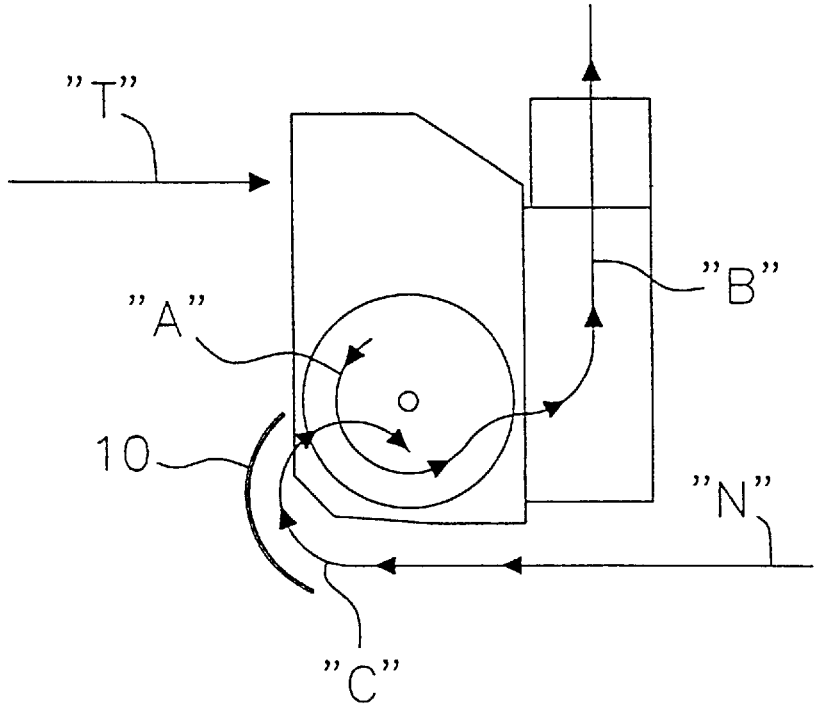
FIG. 3 is a schematic representation of a three-stage snow blower when it moves backwards, the snow blower being equipped with a device according to a preferred embodiment, the blade of the device being in an operative position.
Figure 4:
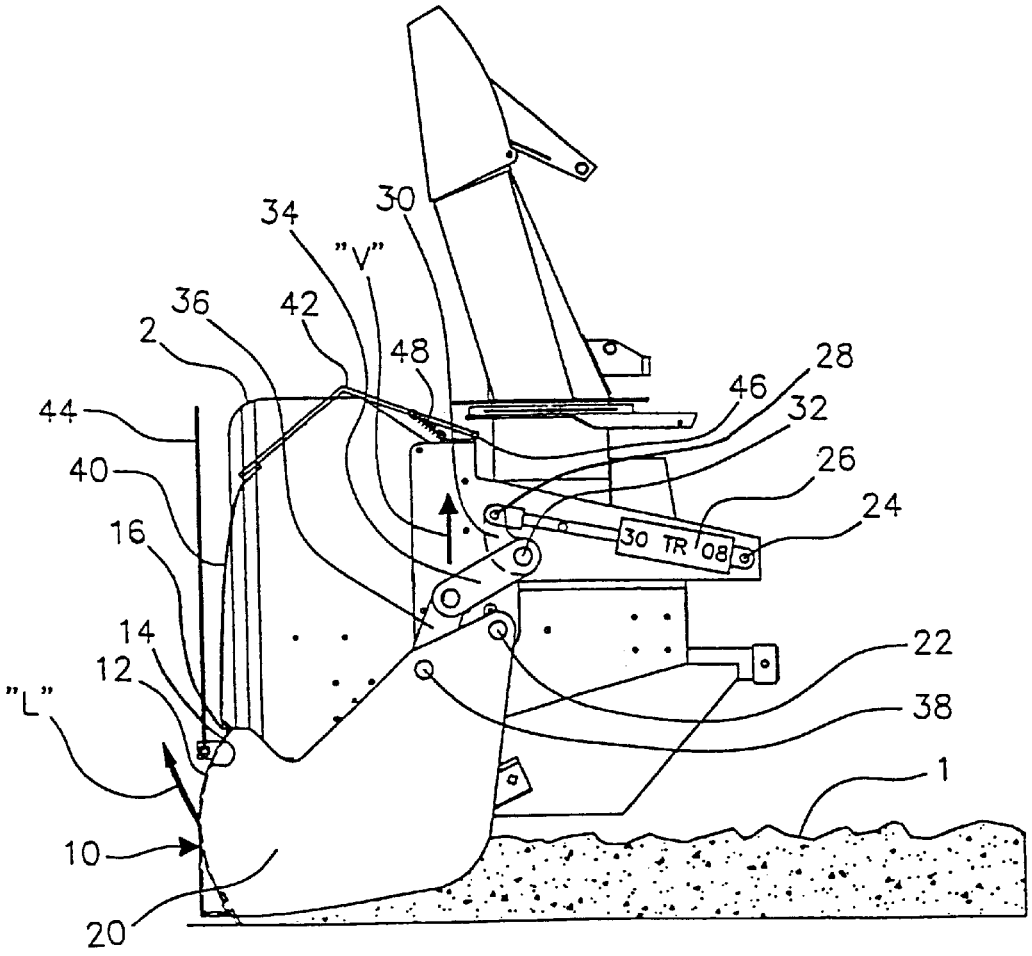
FIG. 4 is a side view of a removable snow blower with a device according to a preferred embodiment of the present invention, where the blade of the device is in operative position.
Figure 5:
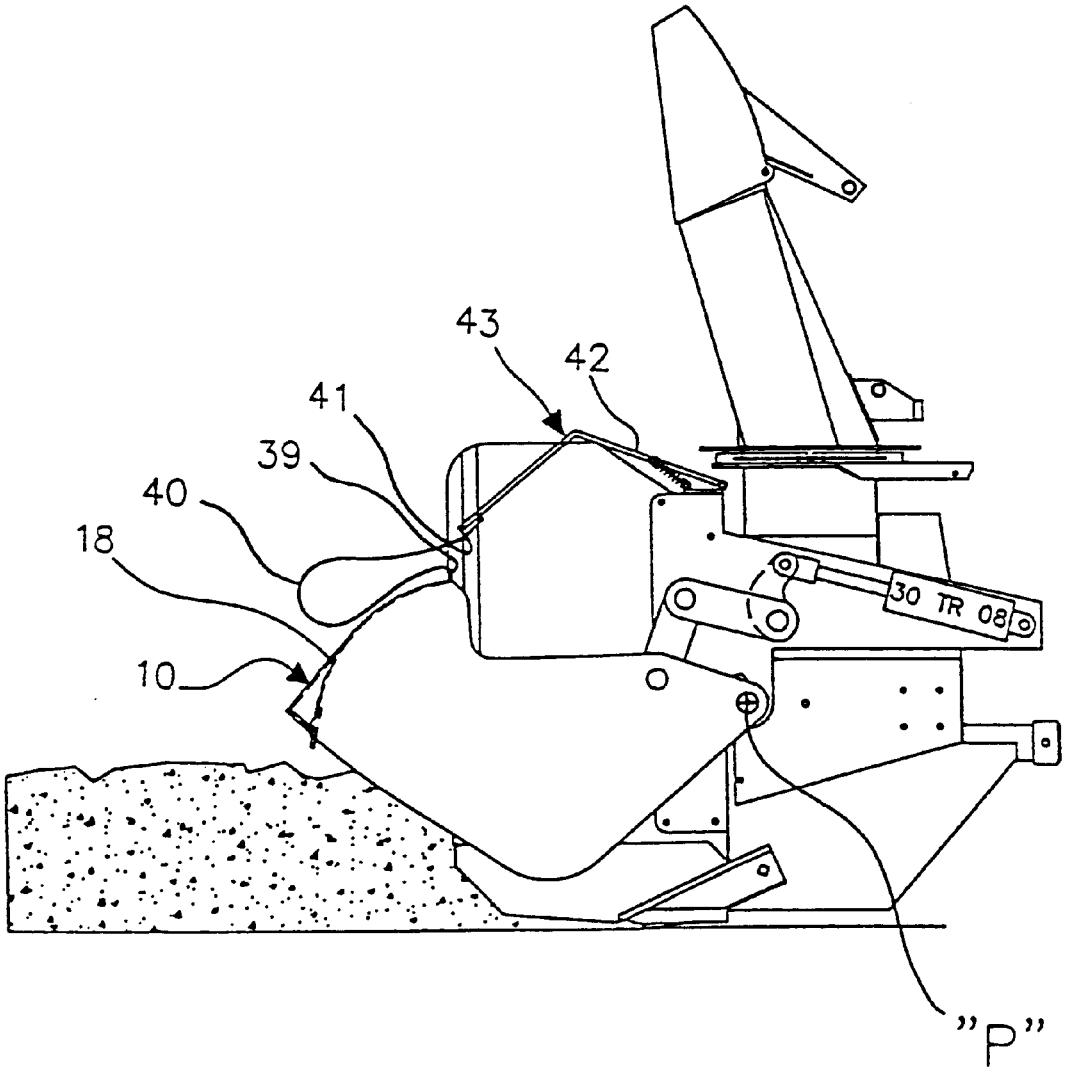
FIG. 5 is a similar view to FIG. 4 where the blade is partially lifted up.
Figure 6:
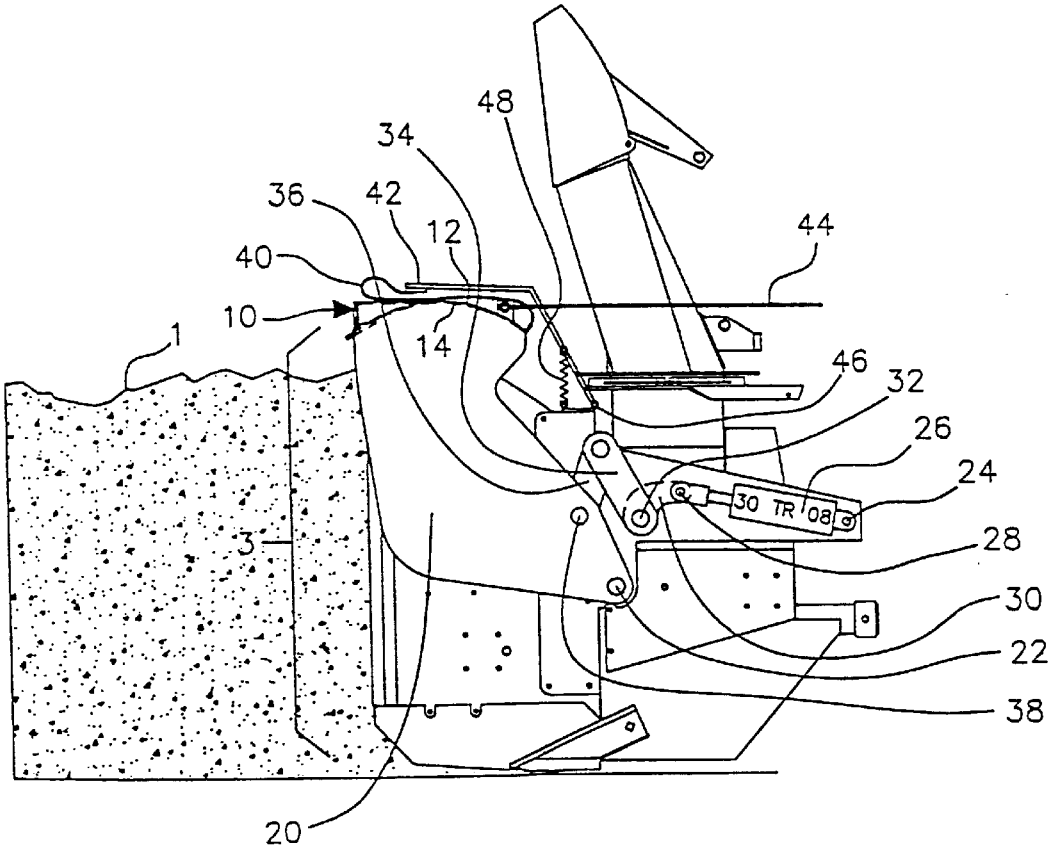
FIG. 6 is a similar view to FIGS. 4 and 5, where the blade is in an inoperative position.

Still referring to FIGS. 4, 5 and 6, the device (10) comprises a blade (12) having a concave surface (14), an upper part (16) and two opposite ends. The blade (12) is pivotally mounted on the snow blower (2) so as to pivot about an axis "P" parallel to the axis of rotation "R" of the auger (4). The device (10) further comprises means for pivoting the blade (12) between an operative position where the blade (12) extends close to ground and the concave surface (14) of the blade (12) extends in front of the front opening (3) in such a way that the blade (12) scrapes the snow (1) and directs it towards the auger (4) when the snow blower (2) moves backwards with the frame (6) and auger (4) lifted up to a predetermined height to let the snow (1) pass, and an inoperative position where the blade (12) is raised to a height sufficient to let the snow (1) reach the auger (4) when the snow blower (2) moves forwards. Avantageously, the blade (12) is at least as wide as the auger in order to produce a maximum of efficiency. As illustrated in FIGS. 3, the snow (1) which is represented by the arrow "N", passes under the snow blower (2), is deflected by the blade (12) and redirected on the auger (4).

According to the preferred embodiment, the blade (12) can be used as a support and the means for pivoting the blade (12) as a lever in order to lift up the frame (6) and auger (4). Thus, the means for pivoting the blade (12) are preferably sufficiently powerful to raise the snow blower frame (6). It is to be understood that the means for lifting up at least the frame (6) and auger (4) could be also any other mechanism devised for that purpose. The height to which the snow blower frame (6) and auger (4) are lifted up is preferably from 6 to 12 inches, depending on the model of snow blower (2).

The means for pivoting the blade (12) preferably include a right assembly and a left assembly which are similar and operate together. Each of the right and left assemblies comprises a support (20) mounted on the snow blower frame (6). The support (20) has one rear top corner pivotally connected to the snow blower frame (6) about a first pivot (22) and a front bottom edge to which the corresponding end of the blade (12) is attached. The means for pivoting the blade (12) preferably further include power means for applying a rotational force "V" on the support (20) in order to pivot the support (20) and the blade (12) connected to it around the first pivot (22). The operator of the snow blower (2) has the possibility of raising the blade (12) to the desired height above the snow (1) depending of its thickness, as it can be observed by comparing FIGS. 5 and 6.

The power means for applying a rotational force "V" on the support (20) comprise a powered cylinder (26) and an L-shaped lever. The powered cylinder (26) has a first end (24) pivotally attached to the snow blower frame (6) and a second end (28). The L-shaped lever has a first end (30) pivotally attached to the second end (28) of the powered cylinder (26), an angular portion pivotally connected to the snow blower frame (6) about a second pivot (32) and a second end (34). The power means for applying a rotational force "V" on the support (20) further comprise a link (36) having one extremity pivotally attached to the second end (34) of the L-shaped lever and another extremity connected to support (20) about a third pivot (38) located at a given distance from the first pivot (22) for transmitting the rotational force "V" to the support (20) and pivoting said support (20). Therefore, the blade (12) pivots around the first pivot (22) when the powered cylinder (26) is actuated thereby causing the L-shaped lever to pivot about the second pivot (32). When the powered cylinder (26) retracts, the second end (34) of the L-shaped lever is raised which pulls on the link (36) and then, pivots the support (20) and the blade (12) around the first pivot (22) in direction "L" illustrated in FIG. 4. Avantageously, the powered cylinder (26) is a hydraulic cylinder. According to the preferred embodiment, the first end (30) and second end (34) of the L-shaped lever are two separated pieces that are tightly and solidly fixed together.

Avantageously, the axis "P" about which the blade (12) pivots, is located behind the axis of rotation "R" of the auger (4).

According to the preferred embodiment of the invention, the device (10) further comprises a flexible shield (40) having an upper border (41) and a lower border (39). The upper border (41) is attached to support means located on top of the snow blower frame (6). The lower border (39) is attached to the upper part (16) of the blade (12) along it. The flexible shield (40) together with the blade (12) in the operative position, cover the front opening of the snow blower frame (6) in such a way as to prevent the snow (1) from being ejected over the blade (12) by the auger (4) in rotation when the snow blower (2) moves backwards. Avantageously, the flexible shield (40) is made of synthetic fabric such as Nylon®, reinforced with rubber. However, the flexible shield (40) can be made of any material that satisfy the need of preventing the snow (1) to be ejected over the blade (12) and fall on the ground that has been cleared of snow (1). It is an important characteristic of the shield (40) to be flexible when the blade (12) is raised in the inoperative position because the shield (40) needs to be folded up as shown in FIGS. 5 and 6.

The support means (43) located on top of the snow blower frame (6) includes a pair of spaced apart arms (42) to which the flexible shield (40) is attached. These arms (42) are positioned to maintain the flexible shield (40) out of view of an operator operating the snow blower (2) when the blade (12) is in the operative position or in the inoperative position. Each of the spaced apart arms (42) extend forwardly in front of the front opening (3) of the snow blower frame (6). Avantageously, each of the spaced apart arms (42) is pivotally attached with a hinge (46) to the snow blower frame (6) and urged down with a spring (48) connected to the frame (6) in such a manner as to keep it at a lowest possible position for maintaining the flexible shield (40) out of the operator's field of view.

Preferably, the blade (12) has proximity indicator rods (44) fastened to each of the opposite ends (18) of the blade (12). The proximity indicator rods (44) extend upwardly in the operator's field of view. These rods (44) help the operator lower the blade (12) close to obstacles such as garage door, wall or the like, without damaging it.

As it can be appreciated, a snow blower (2) equipped with a device (10) according to the invention, may operate while moving backwards and therefore, maximize the productivity of the snow blower (2). The device (10) also has the benefit of allowing the snow blower (2) to blow the certain amount of snow (1) that would be left in front of any obstacles. A method for blowing snow (1) with a snow blower (2) equipped with the device (10) according to the invention, when the snow blower (2) moves backwards, comprises the steps of (i) lifting said snow blower (2) to a predetermined height to let the snow (1) pass under it; (ii) pivoting the blade (12) in the operative position; (iii) driving the auger (4) in rotation; and (iv) moving said snow blower (2) backwards.

Although a preferred embodiment of the invention has been described herein and illustrated in the accompanying drawings, it is to be understood that the invention is not limited to this precise embodiment and that various changes and modifications may be effected therein without departing from the scope or spirit of the invention as defined in the appended claims.

What is claimed is:

1. A device for use with a snow blower to allow said snow blower to operate while moving backwards, said snow blower being of the type comprising:

means for moving said snow blower forwards or backwards in a given direction;

a frame having a front opening, two side portions and an auger located within the frame behind said front opening, said auger having an axis of rotation transverse to the given direction in which said snow blower moves, and two opposite ends, each of said opposite ends of the auger being rotatably fastened to a respective one of said side portions of the snow blower frame, means for driving in rotation said auger;

means for lifting up at least said frame and auger, and means for ejecting snow out of said frame and away from said snow blower when said snow blower is in operation;

said device comprising:

a blade having a concave surface, an upper part and two opposite ends, said blade being pivotally mounted on said snow blower so as to pivot about an axis parallel to the axis of rotation of the auger; and means for pivoting said blade between an operative position where the blade extends close to ground and the concave surface of said blade extends in front of said front opening in such a way that said blade scrapes the snow and directs it towards said auger when said snow blower moves backwards with the frame and auger lifted up to a predetermined height to let the snow pass, and an inoperative position where the blade is raised to a height sufficient to let the snow reach the auger when the snow blower moves forwards.

2. A device according to claim 1, wherein the device further comprises a flexible shield having an upper border and a lower border, said upper border being attached to support means located on top of the snow blower frame, said lower border being attached to the upper part of the blade along it, said flexible shield together with said blade in the operative position covering the front opening of said snow blower frame in such a way as to prevent the snow from being ejected over said blade by the auger in rotation when said snow blower moves backwards.

3. A device according to claim 2, wherein the support means located on top of the snow blower frame includes a pair of spaced apart arms to which the flexible shield is attached, said arms being positioned to maintain said flexible shield out of view of an operator operating the snow blower when the blade is in the operative position or in the inoperative position, each of said spaced apart arms extending forwardly in front of the front opening of the snow blower frame.

4. A device according to claim 3, where each of the spaced apart arms is pivotally attached with a hinge to the snow blower frame and urged down with a spring connected to said frame in such a manner as to keep it at a lowest possible position for maintaining the flexible shield out of said operator's field of view.

5. A device according to claim 2 wherein the flexible shield is made of synthetic fabric reinforced with rubber.

6. A device according to claim 1 wherein the means for pivoting the blade include a right assembly and a left assembly which are similar and operate together,m each of said right and left assemblies comprises:

a support mounted on the snow blower frame, said support having one rear top corner pivotally connected to the snow blower frame about a first pivot and a front bottom edge to which the corresponding end of the blade is attached; and power means for applying a rotational force on said support in order to pivot said support and the blade connected to it around said first pivot.

7. A device according to claim 6, wherein the power means for applying a rotational force on the support comprise:

a powered cylinder having a first end pivotally attached to the snow blower frame and a second end;

an L-shaped lever having a first end pivotally attached to the second end of the powered cylinder, an angular portion pivotally connected to the snow blower frame about a second pivot and a second end;

a link having one extremity pivotally attached to the second end of the L-shaped lever and another extremity connected to said support about a third pivot located at a given distance from the first pivot for transmitting the rotational force to said support and pivoting said support and therefore the blade around said first pivot when said powered cylinder is actuated thereby causing the L-shaped lever to pivot about the second pivot.

8. A device according to claim 7, wherein the powered cylinder is a hydraulic cylinder.

9. A device according to claim 1 wherein the axis about which the blade pivots, is located behind the axis of rotation of the auger.

10. A device according to claim 1 wherein the blade has proximity indicator rods fastened to each of the opposite ends of the blade, said proximity indicator rods extending upwardly in the operator's field of view.

11. A method for blowing snow with a snow blower equipped with a device as claimed in claim 1 when said snow blower moves backwards, the method comprising the steps of:

lifting said snow blower to a predetermined height to let the snow pass under it;

pivoting the blade in the operative position;

driving the auger in rotation; and moving said snow blower backwards.

12. A snow blower equipped with a device as claimed in claim 1 for operating while moving backwards.

* * * * *